US007909428B2

(12) United States Patent
Donaldson et al.

(10) Patent No.: US 7,909,428 B2
(45) Date of Patent: Mar. 22, 2011

(54) FLUID EJECTION DEVICES AND METHODS OF FABRICATION

(75) Inventors: Jeremy Harlan Donaldson, Corvallis, OR (US); Michael Hager, Corvallis, OR (US); Bradley D. Chung, Corvallis, OR (US); Thomas R. Strand, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 971 days.

(21) Appl. No.: 11/495,241

(22) Filed: Jul. 28, 2006

(65) Prior Publication Data

US 2008/0024574 A1 Jan. 31, 2008

(51) Int. Cl.
*B41J 2/015* (2006.01)
*B41J 2/14* (2006.01)

(52) U.S. Cl. ..... 347/20; 347/47

(58) Field of Classification Search ..... 347/88, 347/47, 56, 15, 40, 43, 63
See application file for complete search history.

(56) References Cited

U.S. PATENT DOCUMENTS 5,521,622 A * 5/1996 Hock et al. ..... 347/43
6,003,977 A * 12/1999 Weber et al. ..... 347/63
6,042,219 A 3/2000 Higashino et al.
6,137,502 A 10/2000 Anderson et al.
6,142,607 A * 11/2000 Takata et al. ..... 347/47
6,454,393 B2 9/2002 Chen et al.
6,481,819 B2 11/2002 Kaneko et al.
6,513,896 B1 * 2/2003 Kawamura ..... 347/15
6,966,112 B2 11/2005 Kawamura
2003/0197760 A1 * 10/2003 Tsuchii et al. ..... 347/56
2005/0088486 A1 4/2005 Goin et al.
2005/0134643 A1 6/2005 Cho et al.
2006/0001698 A1 * 1/2006 Hart et al. ..... 347/40
2006/0038851 A1 2/2006 Cornell et al.
2006/0057503 A1 3/2006 Bertelsen et al.

FOREIGN PATENT DOCUMENTS

EP 1074387 A 2/2001
EP 1356938 A 10/2003
JP 2002292862 10/2002

* cited by examiner

*Primary Examiner* — Stephen D Meier
*Assistant Examiner* — Carlos A Martinez, Jr.

(57) ABSTRACT

A fluid ejection device includes a fluidic layer assembly mounted to a substrate, the fluidic layer assembly having a raised portion formed on a side that faces away from the substrate. A first nozzle is formed through a portion of the fluidic layer assembly other than the raised portion, and a second, larger nozzle is formed through the raised portion. A method of fabricating a fluid ejection device includes applying a first layer of a photoresist material to a substrate and a second layer of a photoresist material to the first layer. A sequence of exposures defines a first region of soluble material in the first layer that becomes the first nozzle and second and third regions of soluble material in the first and second layers, respectively, that jointly become the second nozzle. A region of insoluble material in the second layer becomes the raised portion.

20 Claims, 7 Drawing Sheets

FLUID EJECTION DEVICES AND METHODS OF FABRICATION

BACKGROUND OF THE INVENTION

Inkjet printing technology is used in many commercial products such as computer printers, graphics plotters, copiers, and facsimile machines. One type of inkjet printing, known as "drop on demand," employs one or more inkjet pens that eject drops of ink onto a print medium such as a sheet of paper. Printing fluids other than ink, such as preconditioners and fixers, can also be utilized. The pen or pens are typically mounted to a movable carriage that traverses back-and-forth across the print medium. As the pens are moved repeatedly across the print medium, they are activated under command of a controller to eject drops of printing fluid at appropriate times. With proper selection and timing of the drops, the desired pattern is obtained on the print medium.

An inkjet pen generally includes at least one fluid ejection device, commonly referred to as a printhead, which has a plurality of orifices or nozzles through which the drops of printing fluid are ejected. Adjacent to each nozzle is a firing chamber that contains the printing fluid to be ejected through the nozzle. Ejection of a fluid drop through a nozzle may be accomplished using any suitable ejection mechanism, such as thermal bubble or piezoelectric pressure wave to name a few. Printing fluid is delivered to the firing chambers from a fluid supply to refill the chamber after each ejection.

To increase print quality and functionality, it is desirable to be able to eject printing fluid of different drop weights from a single printhead. This can be accomplished by designing some of the nozzles in a printhead to eject lower weight drops and other nozzles to eject higher weight drops. However, the different configurations used for the low drop weight nozzles and the high drop weight nozzles make it difficult to optimize overall nozzle performance. For example, the ability to provide adequate refill speeds for the high drop weight nozzles can be compromised by the ability to generate sufficient drop velocity for the low drop weight nozzles, and vice versa. Accordingly, dual drop weight range on a single printhead die is limited by an inherent tradeoff between refill speed and drop velocity.

DETAILED DESCRIPTION OF THE INVENTION

Representative embodiments of the present invention include a fluid ejection device in the form of a printhead used in inkjet printing. However, it should be noted that the present invention is not limited to inkjet printheads and can be embodied in other fluid ejection devices used in a wide range of applications.

Figure 1:
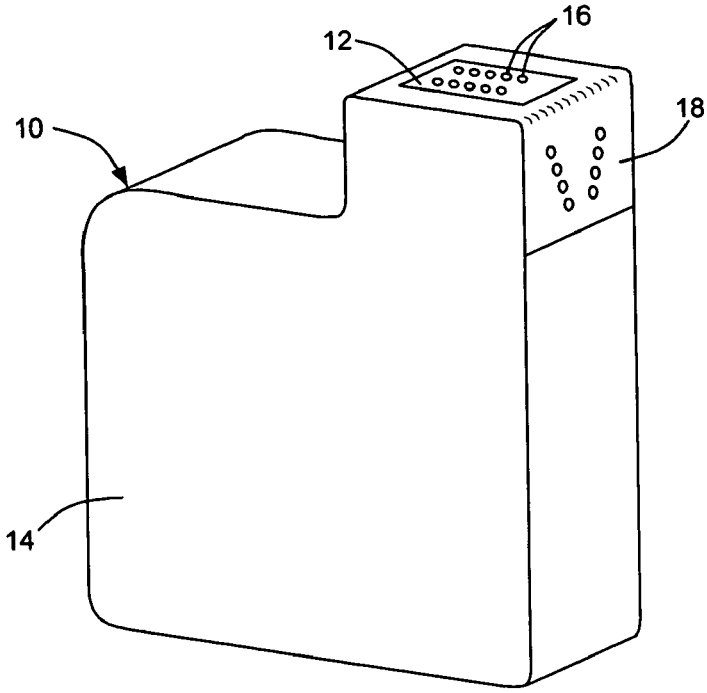
FIG. 1 is a perspective view of an inkjet pen.

Referring to the drawings wherein identical reference numerals denote the same elements throughout the various views, FIG. 1 shows an illustrative inkjet pen 10 having a printhead 12. The pen 10 includes a body 14 that generally contains a printing fluid supply. As used herein, the term "printing fluid" refers to any fluid used in a printing process, including but not limited to inks, preconditioners, fixers, etc. The printing fluid supply can comprise a fluid reservoir wholly contained within the pen body 14 or, alternatively, can comprise a chamber inside the pen body 14 that is fluidly coupled to one or more off-axis fluid reservoirs (not shown). The printhead 12 is mounted on an outer surface of the pen body 14 in fluid communication with the printing fluid supply. The printhead 12 ejects drops of printing fluid through a plurality of nozzles 16 formed therein. Although only a relatively small number of nozzles 16 is shown in FIG. 1, the printhead 12 may have two or more columns with more than one hundred nozzles per column, as is common in the printhead art. Appropriate electrical connectors 18 (such as a tape automated bonding, "flex tape") are provided for transmitting signals to and from the printhead 12.

Figure 2:
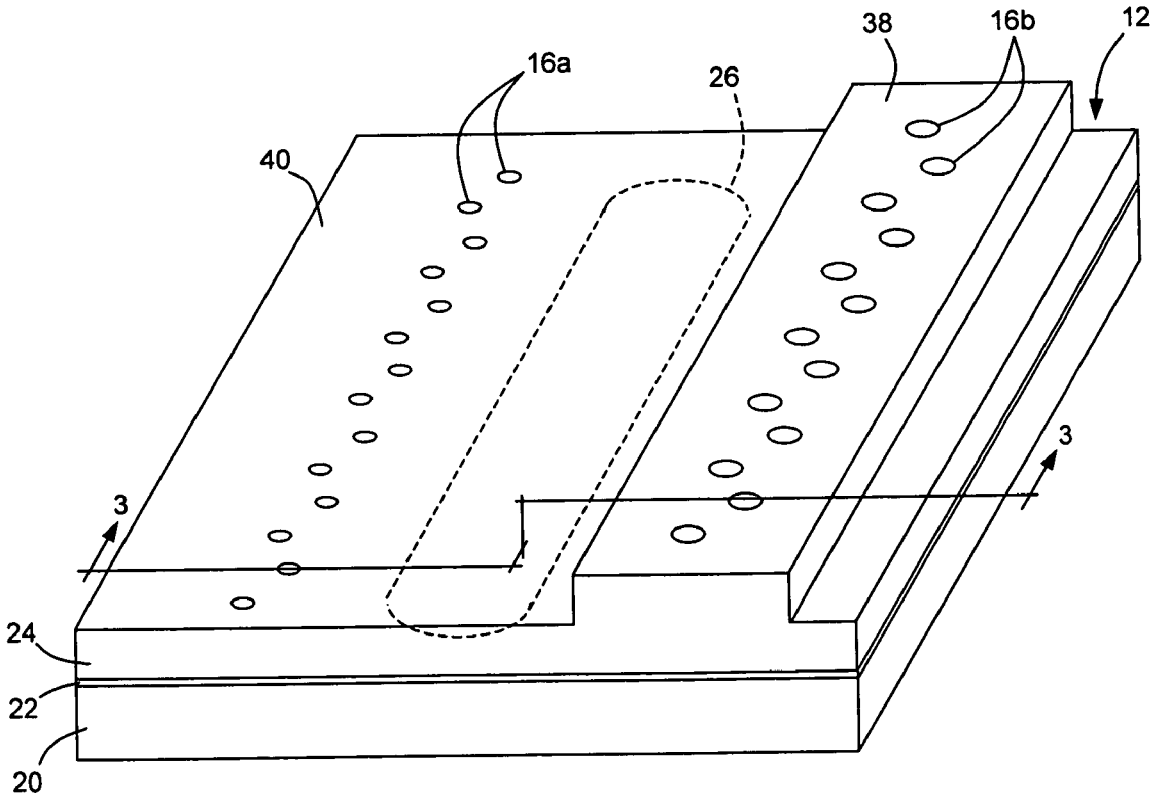
FIG. 2 is a perspective view of an inkjet printhead.
Figure 3:
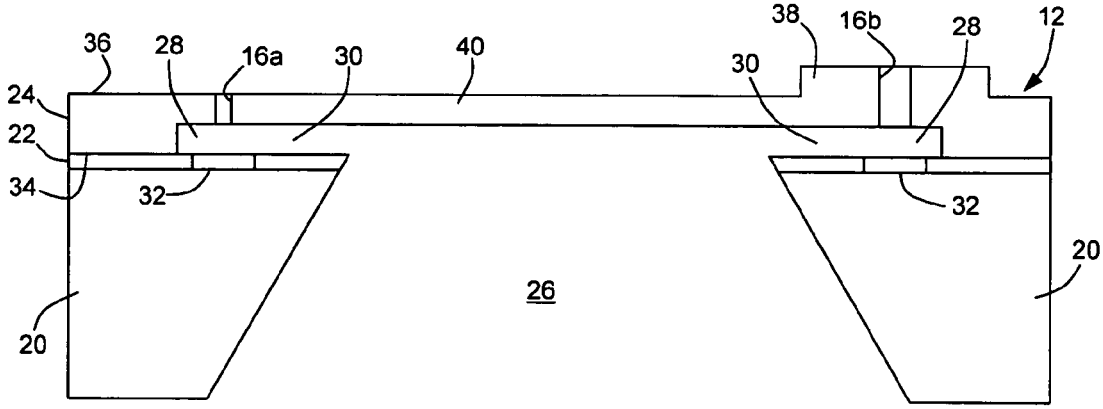
FIG. 3 is a cross-sectional view of the printhead taken along line 3-3 of FIG. 2.

Referring to FIGS. 2 and 3, the printhead 12 includes a substrate 20, a thin film stack 22 disposed on top of the substrate 20, and a fluidic layer assembly 24 disposed on top of the thin film stack 22. At least one ink feed hole 26 is formed in the substrate 20, and the nozzles 16 are arranged around the ink feed hole 26. The nozzles 16 are formed in the fluidic layer assembly 24 and comprise a group of low drop weight nozzles 16*a* and a group of high drop weight nozzles 16*b*. In the illustrated embodiment, the low drop weight nozzles 16*a* are arranged in a first column on a first side of the ink feed hole 26 (the left side in FIG. 3), and the high drop weight nozzles 16*b* are arranged in a second column on a second side of the ink feed hole 26 (the right side in FIG. 3).

Associated with each nozzle 16*a*, 16*b* is a firing chamber 28, a feed channel 30 establishing fluid communication between the ink feed hole 26 and the firing chamber 28, and a fluid ejector 32 which functions to eject drops of printing fluid through the nozzle 16*a*, 16*b*. In the illustrated embodiment, the fluid ejectors 32 are resistors or similar heating elements. It should be noted that while thermally active resistors are described here by way of example only, the present invention could include other types of fluid ejectors such as piezoelectric actuators. The nozzles 16*a*, 16*b*, the firing chambers 28, the feed channels 30 and the ink feed hole 26 are formed in the fluidic layer assembly 24, which is fabricated as multiple layers (as described below). The resistors 32 are contained within the thin film stack 22 that is disposed on top of the substrate 20. As is known in the art, the thin film stack 22 can generally include an oxide layer, an electrically conductive layer, a resistive layer, a passivation layer, and a cavitation layer or sub-combinations thereof. Although FIGS. 2 and 3 depict one common printhead configuration, namely, two rows of nozzles about a common ink feed hole, other configurations may also be formed in the practice of the present invention.

The fluidic layer assembly 24 has a first side 34 that faces the substrate 20 and a second side 36 that faces away from the substrate 20. In the illustrated embodiment, the second side 36 is non-planar or stepped. In this case, the fluidic layer assembly 24 includes a step or raised portion 38 formed on the second side 36, such that the fluidic layer assembly 24 comprises the raised portion 38, which is relatively thick, and a thinner base portion 40.

The low drop weight nozzles 16*a* are formed in the base portion 40, and the high drop weight nozzles 16*b* are formed in the raised portion 38. The high drop weight nozzles 16*b* have larger cross-sectional areas than the low drop weight nozzles 16*a* to provide larger drop weights. Furthermore, because the raised portion 38 is thicker than the base portion 40, the high drop weight nozzles 16*b* are longer or deeper than the low drop weight nozzles 16*a*. As shown in FIG. 3, the nozzles 16*a*, 16*b* have a substantially vertical bore profile. That is, the walls of the nozzle bores are substantially perpendicular to the first and second sides 34 and 36. The nozzles 16*a*, 16*b* can alternatively have a tapered bore profile. If the nozzles have tapered bore profile, this will preferably be in the form of a convergent taper in which the nozzle opening is larger on the first side 34 than the second side 36.

To eject a droplet from one of the nozzles 16*a*, 16*b*, printing fluid is introduced into the associated firing chamber 28 from the ink feed hole 26 (which is in fluid communication with the printing fluid supply (not shown)) via the associated channel 30. The associated resistor 32 is activated with a pulse of electrical current. The resulting heat from the resistor 32 is sufficient to form a vapor bubble in the firing chamber 28, thereby forcing a droplet through the nozzle 16*a*, 16*b*. The firing chamber 28 is refilled after each droplet ejection with printing fluid from the ink feed hole 26 via the feed channel 30.

By virtue of being longer and having a larger cross-sectional area, the high drop weight nozzles 16*b* are able to eject larger droplets without compromising refill speed or drop velocity. Similarly, the low drop weight nozzles 16*a* can eject smaller droplets without sacrificing refill speed or drop velocity because they are shorter and have a smaller cross-sectional area. Accordingly, the printhead 12 provides excellent dual drop weight range on a single printhead die.

Referring to FIGS. 4-8, one process for fabricating an inkjet printhead 12 is described. The process starts with a substrate 20, which is typically a single crystalline or polycrystalline silicon wafer. Other possible substrate materials include gallium arsenide, glass, silica, ceramics, or a semiconducting material. The substrate 20 has a first planar surface 42 and a second planar surface 44, opposite the first surface. The thin film stack 22 is formed or deposited on the first surface 42 of the substrate 20 in any suitable manner, many such techniques being well known in the art. As mentioned above, the thin film stack 22 contains the fluid ejectors 32 and typically includes some or all of an oxide layer, an electrically conductive layer, a resistive layer, a passivation layer, and a cavitation layer.

Next, the fluidic layer assembly 24, which will ultimately define the nozzles 16*a*, 16*b*, the firing chambers 28 and the feed channels 30, is formed on top of the thin film stack 22. In the embodiment of FIGS. 4-8, the fluidic layer assembly 24 is fabricated in three layers: a chamber layer, a first bore layer and a second bore layer. These three layers are formed of any suitable photoimagable materials. One such suitable material is a photopolymerizable epoxy resin known generally in the trade as SU8, which is available from several sources including MicroChem Corporation of Newton, Mass. SU8 is a negative photoresist material, meaning the material is normally soluble in developing solution but becomes insoluble in developing solutions after exposure to electromagnetic radiation, such as ultraviolet radiation. All three layers can be made from the same material, or one or more of the layers can be made of different photoimagable materials. By way of example, this embodiment is described with all three layers comprising a negative photoresist material. However, it should be noted that positive photoresists could alternatively be used. In this case, the mask patterns used in the photoimaging steps would be reversed.

Figure 4:
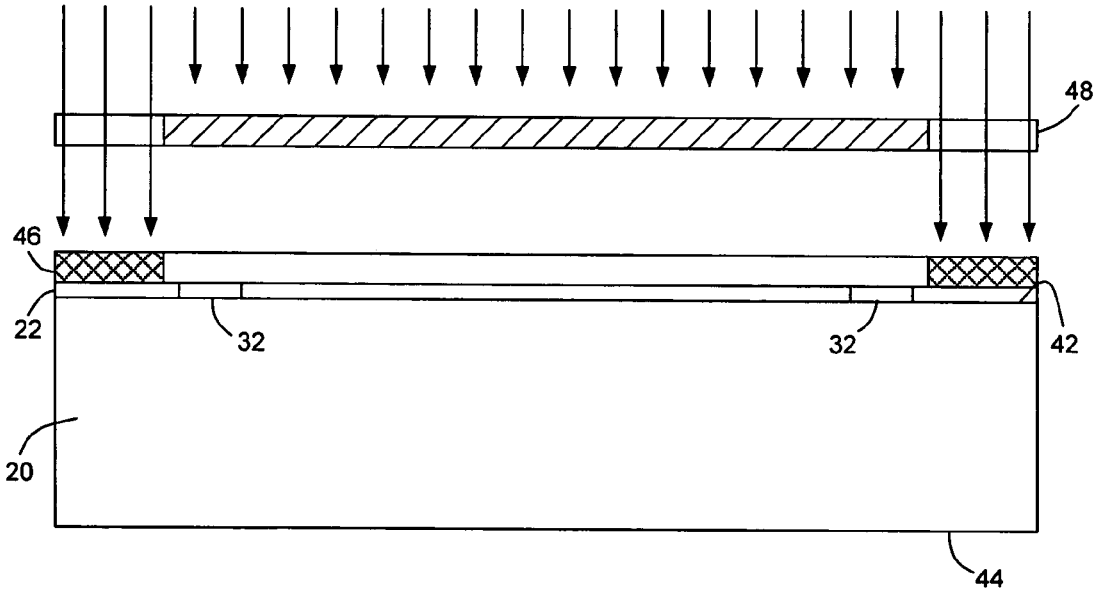
FIGS. 4-8 are cross-sectional views illustrating the steps of a first embodiment of fabricating a printhead.

Fabrication of the fluidic layer assembly 24 begins by applying a layer of a photoresist material to a desired depth over the thin film stack 22 to provide a chamber layer 46, as shown in FIG. 4. The chamber layer 46 is then imaged by exposing selected portions to electromagnetic radiation through a first mask 48, which masks the areas of the chamber layer 46 that are to be subsequently removed and does not mask the areas that are to remain. Because the chamber layer 46 is a negative photoresist material (by way of example), the portions subjected to radiation undergo polymeric cross-linking, which is depicted in the drawings with double hatching, and become insoluble. In the illustrated embodiment, the area of the chamber layer 46 that will be removed is an area in the center of the chamber layer 46 that corresponds to the firing chambers 28 and the feed channels 30.

Figure 5:
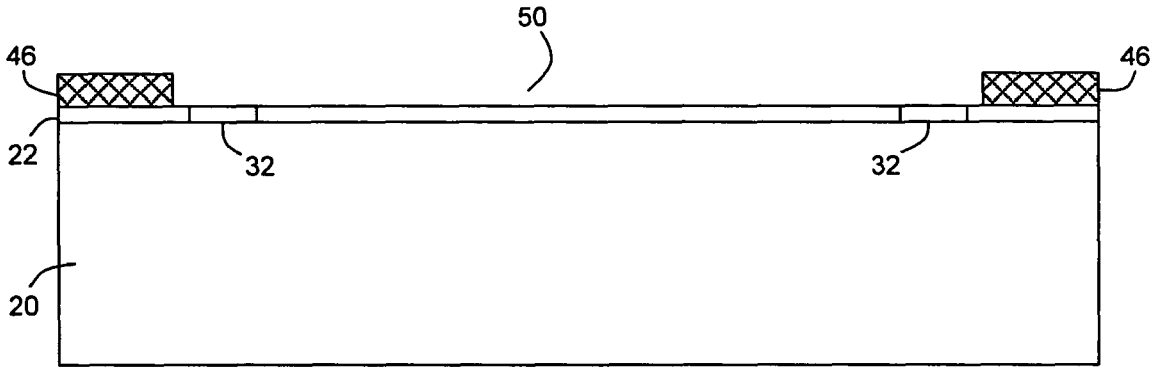

After the light exposure, the chamber layer 46 is developed to remove the unexposed chamber layer material and leave the exposed, cross-linked material. This creates a developed area or void 50, as seen in FIG. 5. The void 50 resulting from the removed chamber layer material will eventually form the firing chambers 28 and the feed channels 30. The chamber layer 46 can be developed using any suitable developing technique which includes, for example, using an appropriate agent or developing solution such as propylene glycol monomethyl ether acetate (PGMEA) or ethyl lactate.

Figure 6:
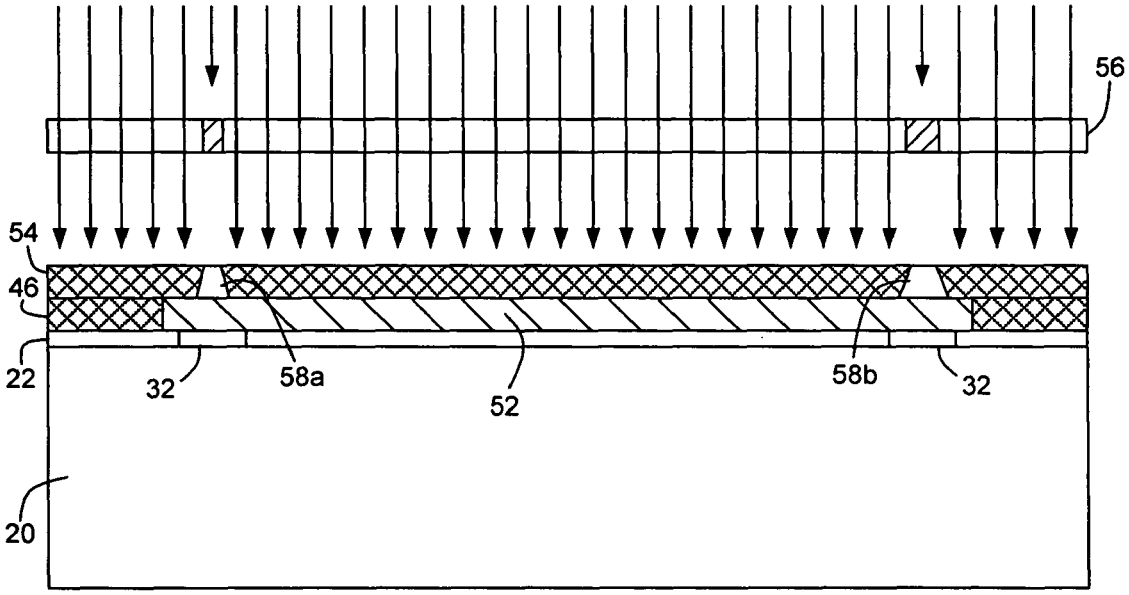

Referring to FIG. 6, a sacrificial fill material 52 is applied so as to fill the void 50. The fill material 52 is then planarized, such as through a resist etch back (REB) process or a chemical mechanical polishing (CMP) process. This planarization process removes any excess fill material to bring the fill material 52 in the void 50 flush with the upper surface of the chamber layer 46. Next, another layer of a photoresist material is applied to a desired depth on the upper surface of the chamber layer 46 to provide a first bore layer 54. The fill material 52 keeps first bore layer material out of the void 50. The first bore layer 54 is possibly, although not necessarily, made of the same material as the chamber layer 46.

The first bore layer 54 is then imaged by exposing selected portions to electromagnetic radiation through a second mask 56, which masks the areas of the first bore layer 54 that are to be subsequently removed and does not mask the areas that are to remain. The areas of the first bore layer 54 that are to be removed are a series of relatively small regions of unexposed, soluble material that will become the nozzles 16*a*, 16*b*. In the illustrated embodiment, this comprises a series of first regions 58*a* (only one shown in FIG. 6) that will become the low drop weight nozzles 16*a* and a series of second regions 58*a* (only one shown in FIG. 6) that will become a lower portion of the high drop weight nozzles 16*b*. The first and second regions 58*a*, 58*b* are aligned with corresponding fluid ejectors 32. The second mask 56 can be patterned such that the first regions 58*a* will be smaller in cross-sectional area than the second regions 58*b*, so that the high drop weight nozzles 16*b* will have larger cross-sectional areas than the low drop weight nozzles 16*a*. For example, the first regions 58*a* can be sized to be 13 microns in diameter, while the second regions 58*b* can be sized to be 20 microns in diameter.

The exposure is carried out at a predetermined focus offset (i.e., the difference between the nominal focal length of the photoimaging system and the relative positioning of the wafer) that provides a desired profile for the regions 58*a*, 58*b* and thus a desired bore profile for the nozzles 16*a*, 16*b*. In the illustrated example, exposure is performed at a relatively high focus offset (e.g., about 7-15 microns) to provide a convergent profile. The first bore layer 54 is typically not developed at this point in the process.

Figure 7:
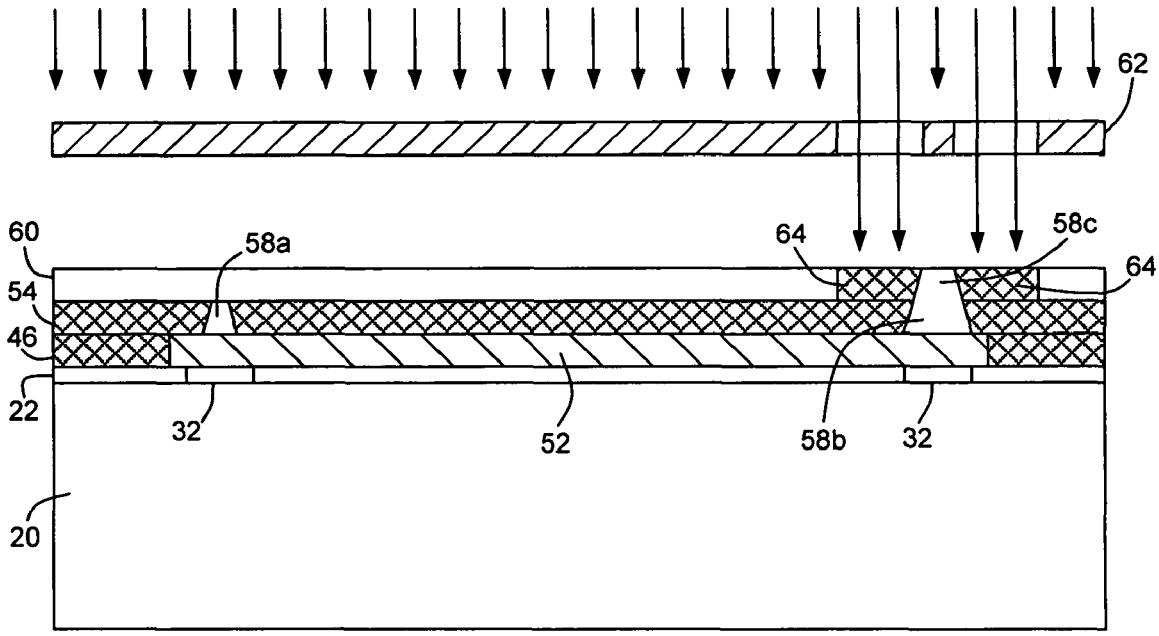

Turning to FIG. 7, another layer of photoresist material is applied to a desired depth on top of the first bore layer 54 to provide a second bore layer 60. The second bore layer 60 is possibly, although not necessarily, made of the same material as the chamber layer 46 and/or the first bore layer 54. The second bore layer 60 is then imaged by exposing selected portions to electromagnetic radiation through a third mask 62, which masks the areas of the second bore layer 60 that are to be removed and does not mask the areas that are to remain. The areas of the second bore layer 60 that are to be removed include a series of third regions of unexposed, soluble material 58*c*, wherein each third region 58*c* is aligned with, and located above, a corresponding one of the second regions 58*b* in the first bore layer 54. The third regions 58*c* are sized similarly to the second regions 58*b* and are formed with a similar convergent profile.

The second bore layer 60 includes a larger region 64 that surrounds the third regions 58*c* and is subjected to the electromagnetic radiation so as to undergo polymeric cross-linking and become insoluble in developing solutions. The region 64, which is not subsequently removed, becomes the raised portion 38 of the fluidic layer assembly 24. The region 64 typically extends the entire length of the second bore layer 60 and has a width that is substantially equal to the desired width of the raised portion, which could be 150 microns, for example, or could be as large as half the die or more. The portions of the second bore layer 60 lying outside of the region 64 are additional areas to be removed and are thus not exposed to electromagnetic radiation.

Figure 8:
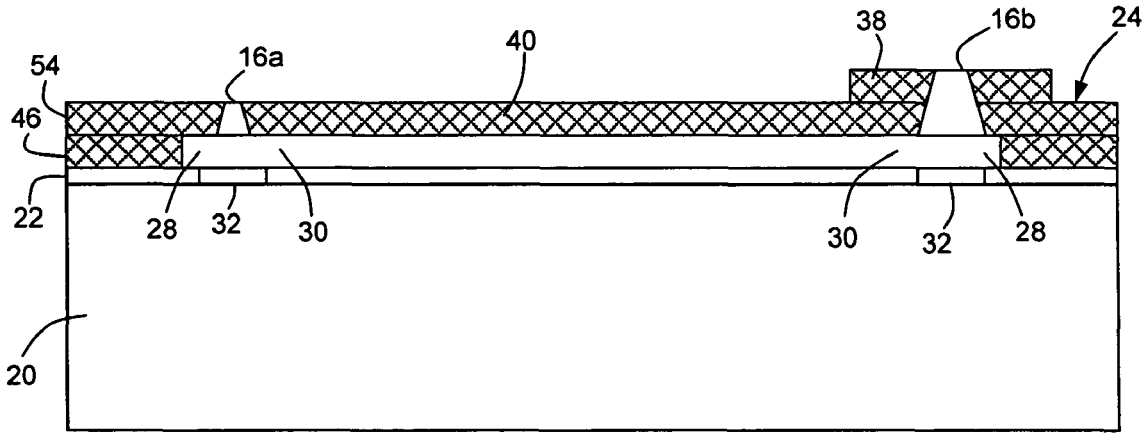

After the first and second bore layers 54 and 60 have been exposed, they are jointly developed (again using any suitable developing technique), to remove the unexposed, soluble bore layer material and leave the exposed, insoluble material, as shown in FIG. 8. This results in the fluidic layer assembly 24 collectively made up by the chamber layer 46, the first bore layer 54, and the second bore layer 60 wherein the remaining portion of the first bore layer 54 makes up the base portion 40 and the remaining portion of the second bore layer 60 defines the raised portion 38. The raised portion 38 is thus formed on the second side 36, with the low drop weight nozzles 16*a* being formed in the base portion 40 and the high drop weight nozzles 16*b* being formed in the raised portion 38. In addition, the fill material 52 filling the void 50 in the chamber layer 46 is also removed, leaving a substantially closed space defining the firing chambers 28 and the feed channels 30 that are in fluid communication with the nozzles 16*a*, 16*b*. The ink feed hole 26 is then formed in the substrate 20 using any suitable technique, including wet etching, dry etching, deep reactive ion etching (DRIE), laser machining, and the like.

Figure 9:
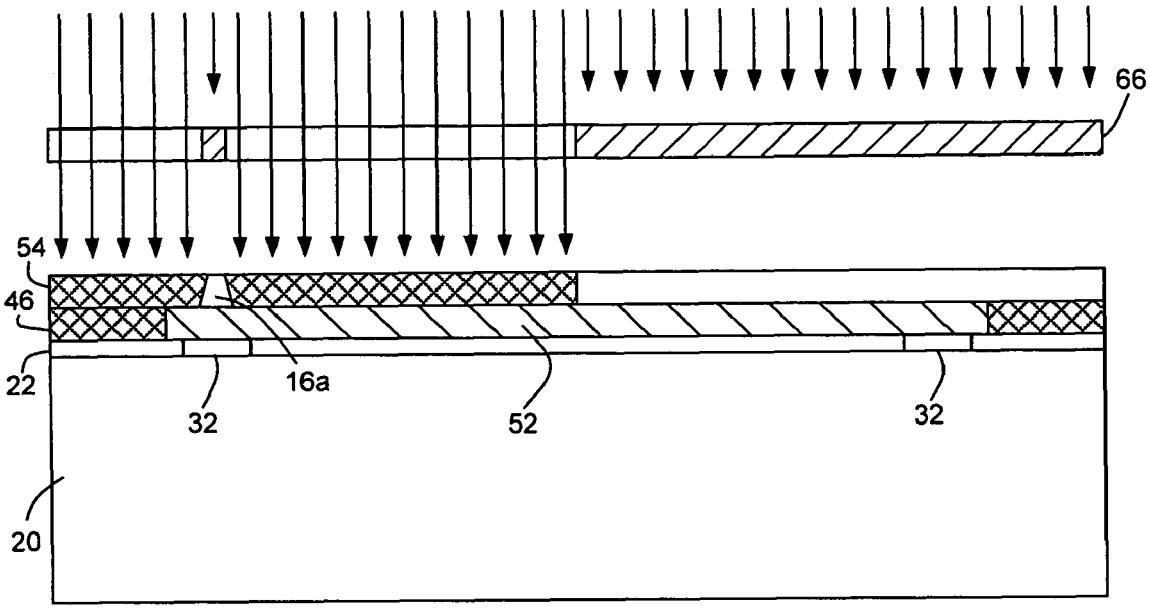
FIGS. 9-11 are cross-sectional views illustrating the steps of a second embodiment of fabricating a printhead.
Figure 10:
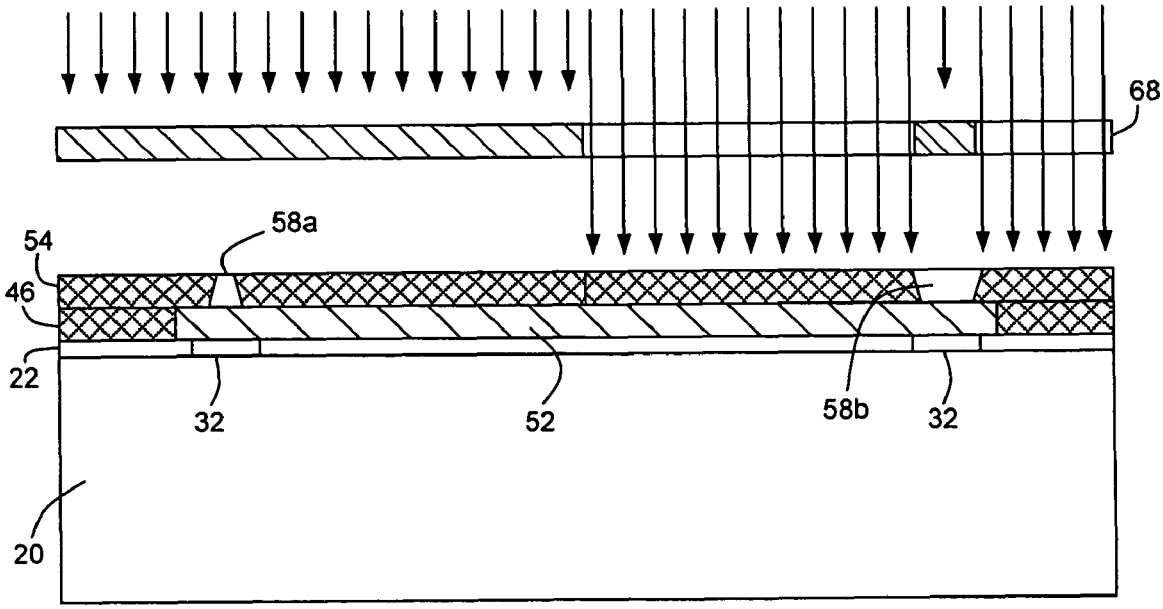
Figure 11:
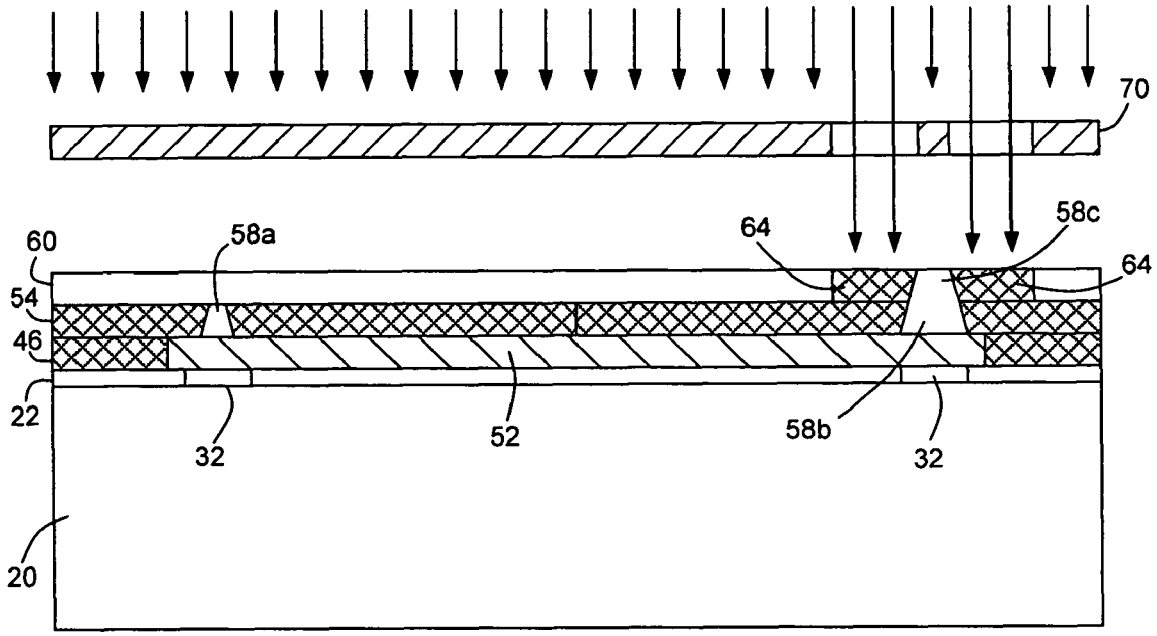

Turning now to FIGS. 9-11, another process for fabricating an inkjet printhead 12 is described. The initial steps for preparing the substrate 20, the thin film stack 22, and the chamber layer 46 (including the void 50 and the fill material 52) are essentially the same as described above and, as such, are not repeated here. As in the first embodiment, the layers comprising the fluidic layer assembly 24 can be formed of any suitable photoimagable materials. By way of example, the layers in this embodiment will also be described as comprising a negative photoresist material, although positive photoresists could alternatively be used.

Once the chamber layer 46 has been applied and processed, a layer of photoresist material is applied to a desired depth on the upper surface of the chamber layer 46 to provide a first bore layer 54, as shown in FIG. 9. The fill material 52 again keeps first bore layer material out of the void 50 in the chamber layer 46. The first bore layer 54 is possibly, although not necessarily, made of the same material as the chamber layer 46.

The first bore layer 54 is then imaged by exposing selected portions to electromagnetic radiation through a fourth mask 66, which masks certain areas of the first bore layer 54 and does not mask the remaining areas. The areas that are not masked, and are thus exposed to radiation, undergo polymeric cross-linking and become insoluble in developing solutions. In this exposure, the entire left side (as seen in FIG. 9) of the first bore layer 54 is exposed except for a first series of relatively small regions of soluble material 58*a* (only one shown in FIG. 9) that will become the low drop weight nozzles 16*a*. In the illustrated embodiment, the first regions 58*a* are aligned with corresponding fluid ejectors 32 and are formed using a suitable focus offset to provide convergent profiles. The right side of the first bore layer 54 is not exposed at this time.

Referring to FIG. 10, the first bore layer 54 is further imaged by exposing selected portions to electromagnetic radiation through a fifth mask 68, which masks certain other areas of the first bore layer 54 and does not mask the remaining areas. In this exposure, the entire right side of the first bore layer 54 that was not previously exposed is exposed except for a second series of relatively small regions of soluble material 58*b* (only one shown in FIG. 10) that will become the high drop weight nozzles 16*b*. In the illustrated embodiment, the second regions 58*b* are aligned with corresponding fluid ejectors 32 and are formed with a low focus offset (e.g., about 4 microns or less) to create a divergent profile. This will prevent any mixing of the fill material 52 and the unexposed first bore layer material.

The fourth and fifth masks 66 and 68 can be patterned such that the first regions 58*a* will be smaller than the second regions 58*b*, so that the high drop weight nozzles 16*b* will have larger cross-sectional areas than the low drop weight nozzles 16*a*. For example, the first regions 58*a* can be sized to be 13 microns in diameter, while the second regions 58*b* can be sized to be 20 microns in diameter. The first bore layer 54 is typically not developed at this point in the process.

Referring to FIG. 11, another layer of photoresist material is applied to a desired depth on top of the first bore layer 54 to provide a second bore layer 60. The second bore layer 60 is possibly, although not necessarily, made of the same material as the chamber layer 46 and/or the first bore layer 54. The second bore layer 60 is then imaged by exposing selected portions to electromagnetic radiation through a sixth mask 70, which masks the areas of the second bore layer 60 that are to be removed and does not mask the areas that are to remain. Selected portions of the first bore layer 54 are also cross-linked by this exposure, thus reducing the amount of soluble material in the second regions 58*b*. The areas of the second bore layer 60 that are to be removed include a series of third regions of soluble material 58*c*, wherein each third region 58*c* is aligned over a corresponding one of the second regions 58*b* in the first bore layer 54. The third regions 58*c* are formed using a focus offset that provides a convergent profile.

The second bore layer 60 includes a larger region 64 that surrounds the third regions 58*c* and is subjected to the electromagnetic radiation so as to undergo polymeric cross-linking and become insoluble in developing solutions. The region 64, which is not subsequently removed, becomes the raised portion 38 of the fluidic layer assembly 24. The region 64 typically extends the entire length of the second bore layer 60 and has a width that is substantially equal to the desired width of the raised portion, which could be 150 microns for example. The portions of the second bore layer 60 lying outside of the region 64 are additional areas to be removed and are thus not exposed to electromagnetic radiation.

After the first and second bore layers 54 and 60 have been exposed, they are jointly developed (again using any suitable developing technique), to remove the unexposed, soluble bore layer material and leave the exposed, insoluble material. This results in the fluidic layer assembly 24 (collectively made up by the chamber layer 46, the first bore layer 54, and the second bore layer 60) having the raised portion 38 formed on the second side 36, with the low drop weight nozzles 16*a* formed in the base portion 40 and the high drop weight nozzles 16*b* formed in the raised portion 38. In addition, the fill material 52 filling the void 50 in the chamber layer 46 is also removed, leaving a substantially closed space defining the firing chambers 28 and the feed channels 30 that are in fluid communication with the nozzles 16*a*, 16*b*. The ink feed hole 26 is then formed in the substrate 20 using any suitable technique, including wet etching, dry etching, deep reactive ion etching (DRIE), laser machining, and the like.

Figure 12:
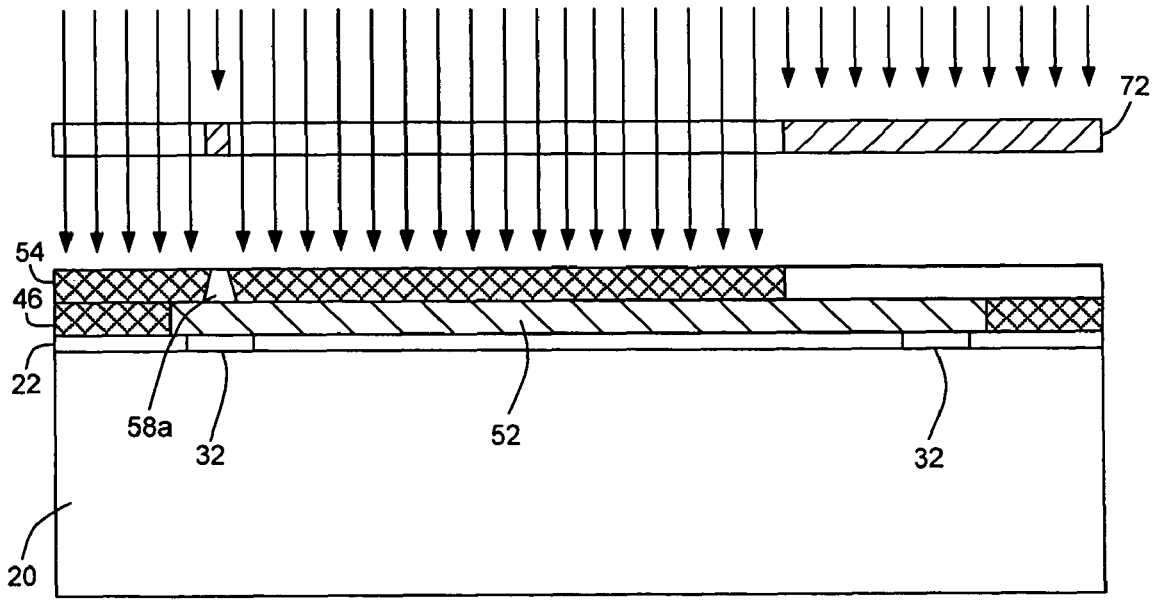
FIGS. 12 and 13 are cross-sectional views illustrating the steps of a third embodiment of fabricating a printhead.
Figure 13:
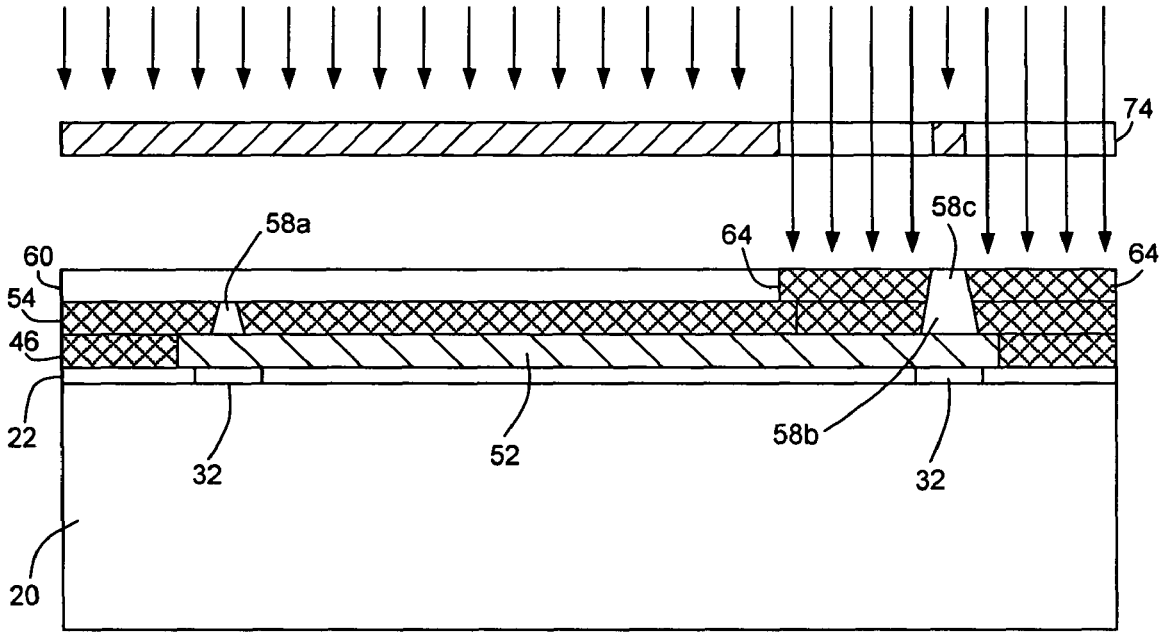

Turning now to FIGS. 12 and 13, yet another process for fabricating an inkjet printhead 12 is described. Again, the initial steps for preparing the substrate 20, the thin film stack 22, and the chamber layer 46 (including the void 50 and the fill material 52) are essentially the same as described above and, as such, are not repeated here. As in the first two described embodiments, the layers comprising the fluidic layer assembly 24 can be formed of any suitable photoimagable materials. By way of example, the layers in this embodiment will also be described as comprising a negative photoresist material, although positive photoresists could alternatively be used.

Once the chamber layer 46 has been applied and processed, a layer of photoresist material is applied to a desired depth on the upper surface of the chamber layer 46 to provide a first bore layer 54, as shown in FIG. 12. The fill material 52 again keeps first bore layer material out of the void 50 in the chamber layer 46. The first bore layer 54 is possibly, although not necessarily, made of the same material as the chamber layer 46.

The first bore layer 54 is then imaged by exposing selected portions to electromagnetic radiation through a seventh mask 72, which masks certain areas of the first bore layer 54 and does not mask the remaining areas. The areas that are not masked, and are thus exposed to radiation, undergo polymeric cross-linking and become insoluble in developing solutions. In this exposure, the entire left side of the first bore layer 54 (as seen in FIG. 12) is exposed except for a first series of relatively small regions of soluble material 58*a* (only one shown in FIG. 12) that will become the low drop weight nozzles 16*a*. In the illustrated embodiment, the first regions 58*a* are aligned with corresponding fluid ejectors 32. The right side of the first bore layer 54 is not exposed at this time.

Referring to FIG. 13, another layer of photoresist material is applied to a desired depth on top of the first bore layer 54 (before developing the first bore layer 54) to provide a second bore layer 60. The second bore layer 60 is possibly, although not necessarily, made of the same material as the chamber layer 46 and/or the first bore layer 54. The second bore layer 60 is then imaged by exposing selected portions to electromagnetic radiation through an eighth mask 74, which masks the areas of the second bore layer 60 that are to be subsequently removed and does not mask the areas that are to remain. This exposure step also exposes certain areas in the portion on the right side of the first bore layer 54 that were not previously exposed. The areas of the first and second bore layers 54 and 60 that are to be removed include a second series of relatively small regions of soluble material 58*b* in the first bore layer 54 and a third series of relatively small regions of soluble material 58*c* in the second bore layer 60 (only one of each shown in FIG. 13) that will become the high drop weight nozzles 16*b*. Accordingly, between the two exposures, the entire first bore layer 54, except for the first and second regions 58*a* and 58*b*, is exposed to radiation. In the illustrated embodiment, the second and third regions 58*b* and 58*c* are aligned with each other and with corresponding fluid ejectors 32. The seventh and eighth masks 72 and 74 can be patterned such that the first regions 58*a* will be smaller than the second and third regions 58*b* and 58*c*, so that the high drop weight nozzles 16*b* will have larger cross-sectional areas than the low drop weight nozzles 16*a*. For example, the first regions 58*a* can be sized to be 13 microns in diameter, while the second and third regions 58*b* and 58*c* can be sized to be 20 microns in diameter.

The second bore layer 60 includes a larger region 64 that surrounds the second regions 58*b* and is subjected to the electromagnetic radiation so as to undergo polymeric cross-linking and become insoluble in developing solutions. The region 64, which is not subsequently removed, becomes the raised portion 38 of the fluidic layer assembly 24. The region 64 typically extends the entire length of the second bore layer 60 and has a width that is substantially equal to the desired width of the raised portion, which could be 150 microns for example. The region 64 is preferably large enough to overlap (as shown in FIG. 13) the portion of the first bore layer 54 that was exposed during the first exposure step. The remaining portions of the second bore layer 60 are additional areas to be removed and are thus not exposed to electromagnetic radiation.

After the first and second bore layers 54 and 60 have been exposed, they are jointly developed (again using any suitable developing technique), to remove the unexposed, soluble bore layer material and leave the exposed, insoluble material. This results in the fluidic layer assembly 24 (collectively made up by the chamber layer 46, the first bore layer 54, and the second bore layer 60) having the raised portion 38 formed on the second side 36, with the low drop weight nozzles 16*a* formed in the base portion 40 and the high drop weight nozzles 16*b* formed in the raised portion 38. In addition, the fill material 52 filling the void 50 in the chamber layer 46 is also removed, leaving a substantially closed space defining the firing chambers 28 and the feed channels 30 that are in fluid communication with the nozzles 16*a*, 16*b*. The ink feed hole 26 is then formed in the substrate 20 using any suitable technique, including wet etching, dry etching, deep reactive ion etching (DRIE), laser machining, and the like.

While specific embodiments of the present invention have been described, it should be noted that various modifications thereto could be made without departing from the spirit and scope of the invention as defined in the appended claims.

What is claimed is:

1. A fluid ejection device comprising:

a substrate;

a fluidic layer assembly, composed of multiple layers, is mounted to said substrate, said fluidic layer assembly having a first side facing said substrate and a second side facing away from said substrate, and wherein said fluidic layer assembly includes a raised portion formed on said second side;

a first nozzle formed through said fluidic layer assembly in a portion other than said raised portion; and a second nozzle formed through said fluidic layer assembly in said raised portion, wherein said first nozzle and said second nozzle extend through said fluidic layer assembly from said first side to said second side, and wherein said second nozzle is longer than said first nozzle and, from said first side of said fluidic layer assembly, has a converging cross-sectional area larger than that of said first nozzle at said first side of said fluidic layer assembly and, to said second side of said fluidic layer assembly, has a converging cross-sectional area larger than that of said first nozzle at said second side of said fluidic layer assembly.

2. The fluid ejection device of claim 1 wherein said first nozzle provides a low drop weight nozzle and said second nozzle provides a high drop weight nozzle.

3. The fluid ejection device of claim 1 further comprising a first fluid ejector associated with said first nozzle and a second fluid ejector associated with said second nozzle.

4. The fluid ejection device of claim 1 wherein said fluid ejection device is an inkjet printhead.

5. The fluid ejection device of claim 1 further comprising a first firing chamber and a first feed channel associated with said first nozzle and a second firing chamber and a second feed channel associated with said second nozzle.

6. The fluid ejection device of claim 1 further comprising an ink feed hole formed in said substrate, and wherein said first nozzle is on one side of said ink feed hole and said second nozzle is on another side of said ink feed hole.

7. The fluid ejection device of claim 1 wherein a thickness of said fluidic layer assembly at said raised portion is greater than a thickness of said fluidic layer assembly at said portion other than said raised portion.

8. The fluid ejection device of claim 1 wherein said first nozzle is formed through a first bore layer of said fluidic layer assembly and said second nozzle is formed through said first bore layer and a second bore layer of said fluidic layer assembly.

9. An inkjet printhead comprising:

a substrate;

a chamber layer disposed on said substrate, said chamber layer defining first and second firing chambers;

a first bore layer disposed on an upper surface of said chamber layer;

a second bore layer covering a portion of an upper surface of said first bore layer;

a low drop weight nozzle formed through said first bore layer so as to be in fluid communication with said first firing chamber; and a high drop weight nozzle formed through said first and second bore layers so as to be in fluid communication with said second firing chamber, wherein said high drop weight nozzle is longer than said low drop weight nozzle and has a larger cross-sectional area through said first bore layer than said low drop weight nozzle through said first bore layer.

10. The inkjet printhead of claim 9 further comprising an ink feed hole formed in said substrate, and wherein said low drop weight nozzle is on one side of said ink feed hole and said high drop weight nozzle is on another side of said ink feed hole.

11. The inkjet printhead of claim 9 wherein said low drop weight nozzle is one of a plurality of low drop weight nozzles formed through said first bore layer and said high drop weight nozzle is one of a plurality of high drop weight nozzles formed through said first and second bore layers.

12. The inkjet printhead of claim 11 further comprising an ink feed hole formed in said substrate, and wherein said plurality of low drop weight nozzles is located on one side of said ink feed hole and said plurality of high drop weight nozzles is located on another side of said ink feed hole.

13. The inkjet printhead of claim 9 further comprising a first fluid ejector associated with said low drop weight nozzle and a second fluid ejector associated with said high drop weight nozzle.

14. The inkjet printhead of claim 9 wherein said high drop weight nozzle has a larger cross-sectional area through said first bore layer and said second bore layer than said low drop weight nozzle through said first bore layer.

15. A fluid ejection device comprising:

a substrate;

a fluidic layer assembly, composed of multiple layers, is mounted to said substrate, said fluidic layer assembly having a first side facing said substrate and a second side facing away from said substrate, and wherein said fluidic layer assembly includes a raised portion formed on said second side;

a first nozzle formed through said fluidic layer assembly in a portion other than said raised portion; and a second nozzle formed through said fluidic layer assembly in said raised portion, wherein said first nozzle and said second nozzle extend through said fluidic layer assembly from said first side to said second side, and wherein said second nozzle is longer than said first nozzle and has a larger cross-sectional area than said first nozzle at said first side of said fluidic layer assembly and at said second side of said fluidic layer assembly, wherein said first nozzle is formed through a first bore layer of said fluidic layer assembly and said second nozzle is formed through said first bore layer and a second bore layer of said fluidic layer assembly.

16. The fluid ejection device of claim 15 wherein said second nozzle has a larger cross-sectional area through said first bore layer and said second bore layer than said first nozzle through said first bore layer.

17. The fluid ejection device of claim 15 wherein said first nozzle provides a low drop weight nozzle and said second nozzle provides a high drop weight nozzle.

18. The fluid ejection device of claim 15 further comprising a first fluid ejector associated with said first nozzle and a second fluid ejector associated with said second nozzle.

19. The fluid ejection device of claim 15 further comprising a first firing chamber and a first feed channel associated with said first nozzle and a second firing chamber and a second feed channel associated with said second nozzle.

20. The fluid ejection device of claim 15 further comprising an ink feed hole formed in said substrate, and wherein said first nozzle is on one side of said ink feed hole and said second nozzle is on another side of said ink feed hole.

* * * * *